US005704264A

United States Patent [19]

Blenke et al.

[11] Patent Number: 5,704,264

[45] Date of Patent: Jan. 6, 1998

[54] CUTTING DIE WITH ELEVATED STRIPPING LAND

[75] Inventors: Timothy James Blenke; James Richard Larsen, both of Neenah, Wis.

[73] Assignee: Kimberly-Clark Worldwide, Inc., Neenah, Wis.

[21] Appl. No.: 522,051

[22] Filed: Aug. 31, 1995

[51] Int. Cl.[6] ..... B26D 1/56

[52] U.S. Cl. ..... 83/27; 83/37; 83/116; 83/346; 83/663

[58] Field of Search ..... 83/24, 27, 37, 83/42, 113, 115, 116, 346, 663, 669, 56, 100, 347; 76/107.1, 107.8; 493/342, 370, 373, 472

[56] References Cited

U.S. PATENT DOCUMENTS

| | | | |
|---|---|---|---|
| 3,143,022 | 8/1964 | Andersen | 83/341 |
| 3,498,158 | 3/1970 | Kougel | 76/107.1 |
| 3,555,948 | 1/1971 | Olson | 83/346 X |
| 3,905,283 | 9/1975 | Baker | 83/346 X |
| 3,981,213 | 9/1976 | Lopman | 83/346 |
| 4,016,786 | 4/1977 | Korner | 83/9 |
| 4,464,959 | 8/1984 | Larson | 83/37 |
| 4,608,895 | 9/1986 | Bell et al. | 83/345 |
| 4,640,165 | 2/1987 | McMahon et al. | 83/663 X |
| 4,663,220 | 5/1987 | Wisneski et al. | 428/221 |
| 4,720,415 | 1/1988 | Vander Wielen et al. | 428/152 |
| 4,932,932 | 6/1990 | Schmidt et al. | 493/200 |
| 4,993,293 | 2/1991 | Christoffersson et al. | 83/24 X |
| 5,088,367 | 2/1992 | Cracchiolo et al. | 83/345 |
| 5,226,992 | 7/1993 | Morman | 156/62.4 |
| 5,417,132 | 5/1995 | Cox et al. | 83/116 |

FOREIGN PATENT DOCUMENTS

| | | | |
|---|---|---|---|
| 6063898 | 3/1994 | Japan | 83/663 |

*Primary Examiner*—Eugenia Jones

*Attorney, Agent, or Firm*—Jeffrey B. Curtin; Thomas D. Wilhelm; Brian R. Tumm

[57] ABSTRACT

This invention pertains to cutting dies for cutting continuous strip elements from a continuous web of fibrous and/or polymeric material. An improved cutting die has an elevated stripping land between adjacent but spaced elongated cutting knives. The elevated stripping land obviates the trim element becoming lodged in the trim zone between the cutting knives, and thereby assists in stripping the trim element from the trim zone.

35 Claims, 5 Drawing Sheets

CUTTING DIE WITH ELEVATED STRIPPING LAND

FIELD OF THE INVENTION

This invention relates to apparatus and methods for cutting a continuous web of material to remove one or more trim elements therefrom while simultaneously separating the web into two or more continuous strips.

BACKGROUND OF THE INVENTION

It is known to cut a continuous web along the length of the web, into a plurality of continuous strips, using e.g. a stationary knife. It is also known to cut a continuous web in a repeating curvilinear or other pattern using a roll having a cutting die imposed thereon, by feeding the web between the cutting die roll and an anvil roll.

Where the web is strong and durable, it is known to remove a continuous trim element from the web, concurrent with the cutting, e.g. by maintaining a tension on the trim element and rolling the trim element up on a take-up roll.

Where the web is less strong, such that the trim element is easily broken if tensioned and wound up on a take-up roll, it is known to remove the trim element using a suction shoe disposed adjacent the cutting locus.

The trim element, of course, should be maintained as small as possible, consistent with good processing, in order to minimize the amount of scrap generated in the trim element. Thus, the need to minimize the size of the trim element to minimize waste is in conflict with the need to make the trim element sufficiently large that the integrity of the trim element is maintained throughout the entirety of the processing steps.

The smaller the trim element, generally the more gentle must be the processes for handling the trim element. The more gentle the processes for handling the trim element, the greater the possibility of losing control of the trim element during processing. It would be desirable to provide apparatus and methods for increasing control over the trim element at the cutting die.

Thus it is an object to provide an improved cutting die which readily releases the trim element for take-up, wherein the cutting die has an elevated stripping land between continuous adjacent but spaced cutting knives.

It is another object to provide improved methods for removing the trim element for take-up by cutting the web using a cutting die having an elevated stripping land.

SUMMARY OF THE DISCLOSURE

The inventors herein have surprisingly discovered that the certainty of continuously removing the trim element from the trim zone between adjacent but spaced cutting knives, during a continuous cutting process, is increased by providing a raised stripping land between the cutting knives.

Thus the invention comprehends a first family of embodiments comprising a cutting die for cutting web elements from a generally endless parent web, the cutting die comprising a die substrate having a base land for receiving the parent web to be cut; first and second elongated cutting knives mounted on the die substrate at the base land, the first and second elongated cutting knives extending to respective first and second cutting edges at respective first and second heights, the first and second heights being measured from the base land, the first and second cutting knives extending alongside but being separated from each other along a path about the circumference of the cutting die, thus defining a trim zone between the first and second elongated cutting knives; and an elevated stripping land in the trim zone, extending alongside and at least propinquant at least one of the first and second elongated cutting knives, the elevated stripping land having a third height, measured from the base land, shorter than the first and second heights.

In preferred embodiments, the elevated stripping land extends alongside both of the first and second cutting knives, preferably extending generally continuously alongside both of the first and second cutting knives. In some embodiments, the elevated stripping land comprises first and second elevated stripping land elements extending alongside respective first and second cutting knives.

Still more preferably, the invention contemplates the first and second cutting knives having respective first and second lengths, and contemplates the elevated stripping land extending along the first and second lengths and between the first and second cutting knives at a generally uniform third height, preferably over the entirety of the trim zone, at a generally uniform third height.

The invention may be represented within the context of the first and second cutting edges being located at an imaginary surface disposed outwardly of the die substrate by the magnitude of the first and second heights, with the elevated stripping land being located at a second imaginary surface intermediate the base land and the first imaginary surface.

The height of the stripping land is preferably at least 30 percent as great as the heights of the cutting edges above the base land, preferably about 40 percent to about 50 percent as great as the heights of the cutting edges, whereby a first depth to the stripping land, measured from the first and second cutting edges, is no more than 70 percent as great as a second depth to the base land.

Preferably, each of the first and second elongated cutting knives has first and second elongated sides, the first elongated sides extending upwardly from the elevated stripping land at a first constant angle, with the second elongated sides extending upwardly from the base land at a second constant angle, the upward extensions of the first and second elongated sides terminating at the respective ones of the first and second cutting edges.

The trim zone comprises a minimum width between the first and second elongated cutting knives, at the first and second heights, of no more than about 0.50 inch, preferably no more than about 0.25 inch.

The invention further comprehends a method of cutting web elements from a generally endless flexible parent web, the parent web optionally including polymeric web components, the parent web having a maximum thickness to be cut, the method comprising the steps of feeding the parent web to a cutting die having first and second elongated cutting knives mounted on a die substrate at a base land, the first and second elongated cutting knives extending to respective first and second cutting edges at respective first and second heights, the first and second heights being measured from the base land, the first and second cutting knives extending alongside but being separated from each other along a path about the circumference of the cutting die, thus defining a trim zone between the first and second cutting knives, and an elevated stripping land in the trim zone, extending alongside at least one of the first and second cutting knives, the elevated stripping land having a third height, measured from the base land, shorter than the first and second heights, the trim zone having a first depth to the stripping land, measured from the first and second cutting edges, less than a second depth to the base land; and bringing the cutting die into cutting relationship with an anvil die, with the parent web between the cutting die and the anvil die, and thereby cutting web elements from the parent web, including a trim element in the trim zone.

The method preferably includes selecting a cutting die having elevated stripping land extending alongside both of the first and second elongated cutting knives, and preferably between the first and second cutting knives at a generally uniform third height.

In preferred embodiments, the method includes selecting a cutting die wherein the first and second elongated cutting edges are located at a first imaginary surface disposed outwardly of the die substrate by the magnitude of the first and second heights, and wherein the elevated stripping land is located at a second imaginary surface intermediate the first base land and the first imaginary surface, with the first depth of the elevated stripping land preferably being no more than about 70 percent as great as the second depth, and the trim zone comprising a minimum width between the first and second cutting edges, at the first and second heights, of no more than about 0.50 inch, preferably no more than about 0.25 inch.

Further, the method preferably includes selecting a cutting die wherein the first depth, from the first and second cutting edges to the stripping land, is no more than about 1.25 times the maximum thickness of the parent web at the trim element, and including the step of stripping the trim element out of the trim zone as a continuous strip of material.

Figure 1:
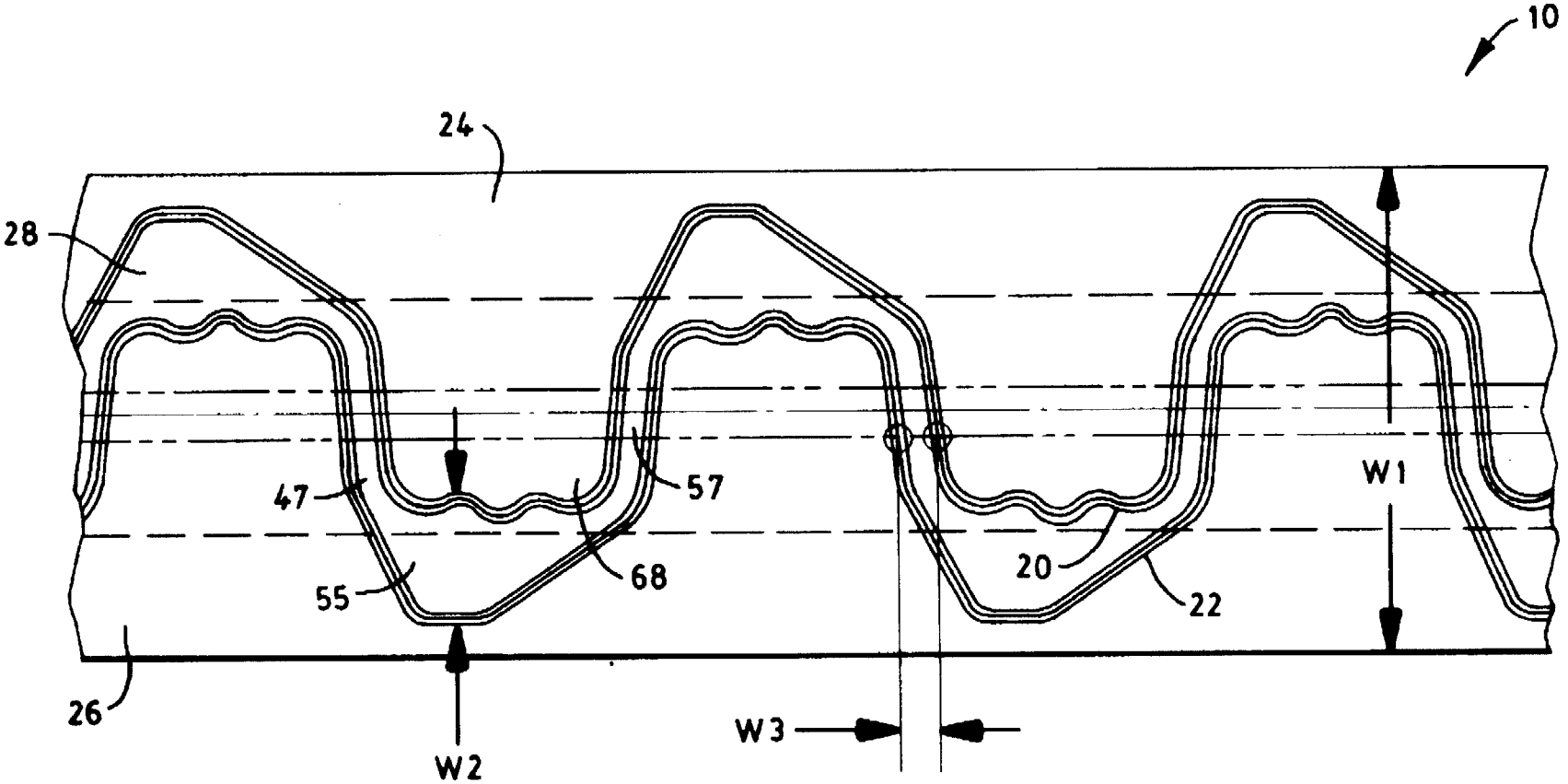
FIG. 1 shows a top view representation of a portion of a continuous web to be cut using apparatus and methods of the invention.

It is to be understood that the invention is not limited in its application to the details of construction and the arrangement of the components set forth in the following description or illustrated in the drawings. The invention is capable of other embodiments or of being practiced or carried out in various ways. Also, it is to be understood that the terminology and phraseology employed herein is for purpose of description and illustration and should not be regarded as limiting. Like reference numerals are used to indicate like elements.

DETAILED DESCRIPTION OF THE ILLUSTRATED EMBODIMENTS

Figure 2:
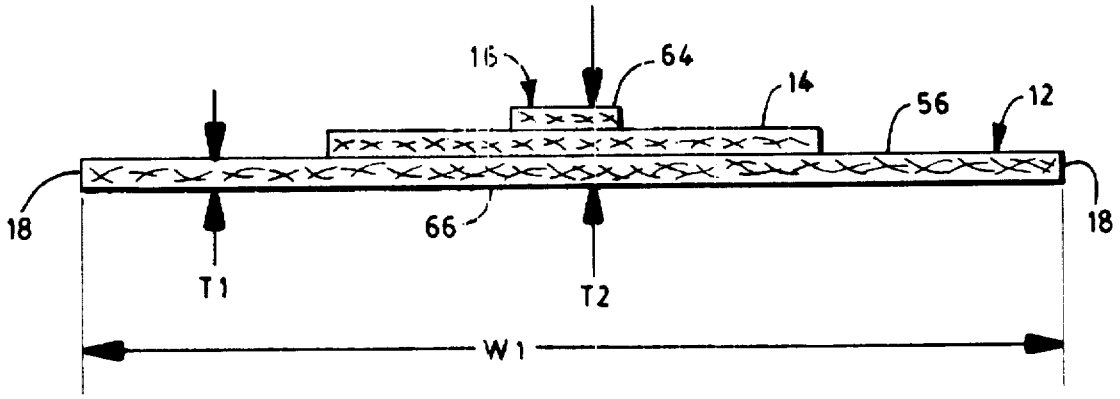
FIG. 2 shows a cross-section across the width of the web of FIG. 1.
Figure 3:
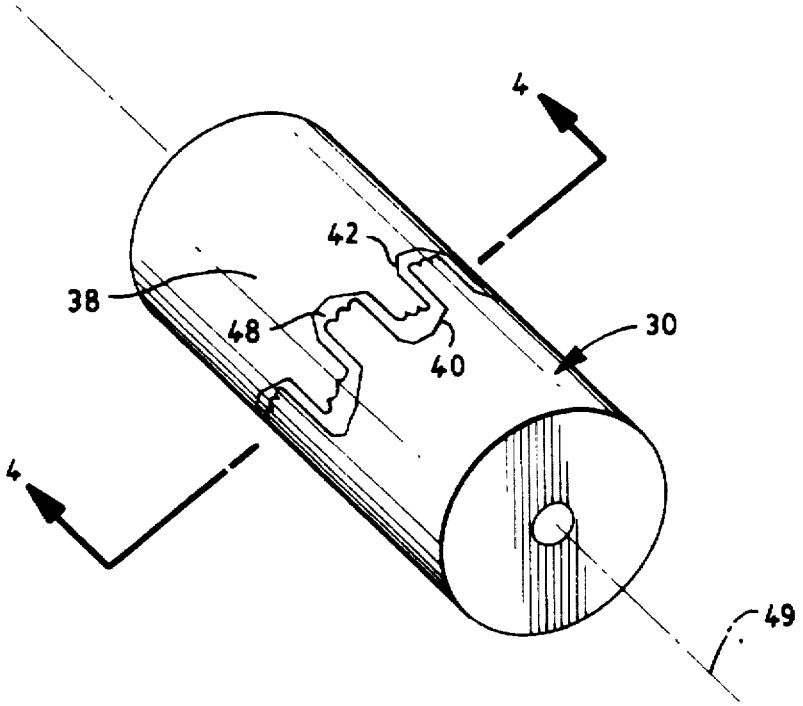
FIG. 3 shows a pictorial view of a cutting die of the invention.
Figure 4:
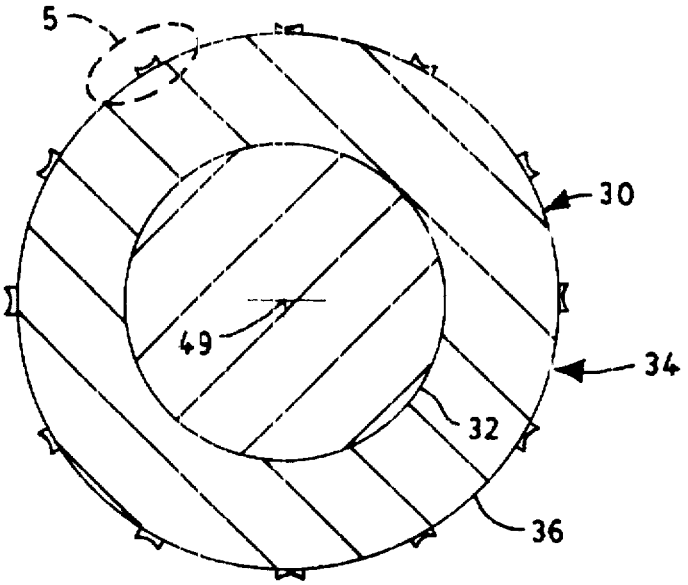
FIG. 4 shows a cross-section of the cutting die of FIG. 3 and is taken at 4—4 of FIG. 3.

Referring now by characters of reference to the drawings, and first to FIGS. 1 and 2, a parent web 10 to be cut is substantially endless, being drawn from, for example, a parent roll (not shown) of such material, and has a width "W1." The web 10 comprises a plurality of layers, represented by the substrate layer 12 extending along the width "W1," the reinforcing layer 14 centrally disposed on, and narrower than, the substrate layer, and the fastening layer 16 centrally disposed on, and narrower than reinforcing layer 14. As shown, the parent web 10 has a minimum thickness "T1" adjacent its edges 18, and a maximum thickness "T2" at its center, generally corresponding with layer 16.

The invention is directed toward cutting the web 10 along cut lines 20, 22 which extend along the length of the web 10 in a serpentine path, to thereby separate the web into two primary tab strip elements 24, 26 and a trim element 28. In processing steps not shown, the tab strip elements 24, 26 are subsequently cut apart at regular intervals along the length of the web, as indicated by the dashed lines 29 in FIG. 6, to thereby create separate tabs 25 for incorporation into disposable absorbent garments such as diapers and the like.

The web 10 is cut using a cutting die 30 generally illustrated in FIGS. 3–8. The cutting die 30 includes a metal core support cylinder 32, and a metal outer sleeve 34 which serves as a substrate carrying the cutting knives. Both the sleeve and the core support cylinder are made of steel or other suitable material.

Figure 5:
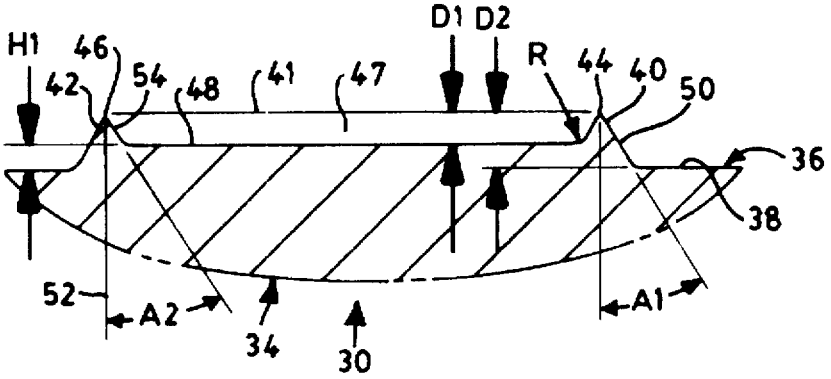
FIG. 5 shows an enlarged cross-section of the cutting knives and trim zone, and is taken at the oval marked "5" in FIG. 4.

Outer sleeve 34 has an outer surface 36 generally corresponding with the outer circumference of the cutting die 30, defining a base land 38 of the cutting die integral with the outer sleeve 34. First and second elongated cutting knives 40, 42, integral with the outer sleeve 34, extend outwardly from the base land 38 about the circumference of the cutting die, to respective cutting edges 44, 46. An elevated stripping land 48, also integral with the outer sleeve 34, defines a trim zone 47 disposed between the cutting knives 40, 42, at and above a height "H1," relative to the axis 49 of the cutting die, above the base land 38, extending up to the cutting edges 44, 46. The height "H1" of the stripping land 48, as illustrated in FIG. 5, is generally uniform about the circumference of the sleeve, and across the width of the trim zone 47. As illustrated in, for example, FIGS. 5 and 7, stripping land 48 comprises non-compressible metal up to the outer surface thereof. The outer surface interacts with the trim element being cut from the parent web. The axis 49 is the center of rotation of the cutting die 30.

Due to the circular nature of the illustrated cutting die 30, the elongated cutting knives are continuous about the circumference of the die, whereby the lengths of the cutting knives are continuous. The depth "D1" of the trim zone 47 is fixed in time, and a constant depth "D1" is preferred. However, depth "D1" may vary along the width "W3," as suggested in FIGS. 1 and 2 by the varying thickness of the web 10 being cut. Thus, the depth "D1" may increase or decrease as one traverses across the width of the trim zone 47, and about the circumference of the roll (which corresponds with the endless length dimension of the trim element 28). Indeed, the stripping land 48, at depth "D1" may be propinquant, but spaced from, one or both of the cutting knives 40, 42.

Figure 8:
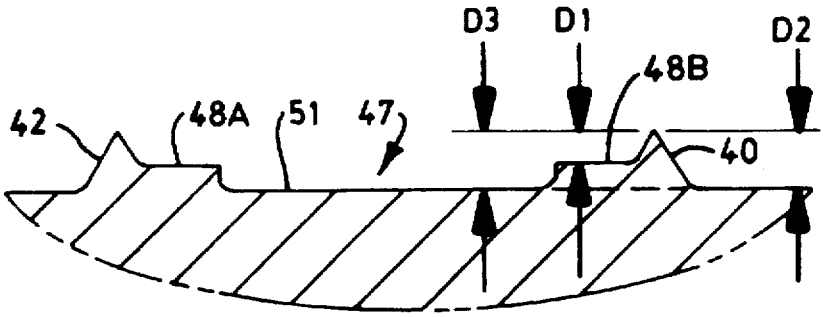
FIG. 8 shows an enlarged cross-section, as in FIGS. 5 and 7, of a second embodiment of the invention.

FIG. 8 illustrates an embodiment wherein stripping land 48 comprises stripping land elements 48A and 48B which extend along, and are contiguous with, both cutting knives 40, 42 with a recessed portion 51 of the trim zone 47 therebetween. In some embodiments, a single stripping land element 48A may be used alone.

The stripping land 48 generally comprises a material which is recognized as being noncompressible, such as steel.

Resiliently compressible materials such as polymeric foams, rubber, and the like are generally not suitable for use between the cutting knives, as the cutting knives were readily broken when using such material for the stripping land.

Accordingly, the base land 38, the stripping land 48, and the cutting knives 40, 42 are all integral elements of the sleeve 34. Further, the depth "D1" from the cutting edges 44, 46 to the stripping land 48 is less than the depth "D2" to the base land 38, and preferably is less than the maximum thickness "T2" of the web 10. Referring to FIG. 8, the depth "D3" may be greater or less than the depth "D2."

A first side 50 of each cutting knife extends upwardly from base land 38 at a preferably constant angle "A1" of about 25 to about 45 degrees from an imaginary line 52 extending through the respective cutting edges 44 or 46 and through the center of rotation. A second side 54 of each cutting knife extends upwardly from stripping land 48 at a preferably constant angle "A2" of about 25 to about 45 degrees from a corresponding imaginary line 52, whereby the first and second sides 50, 54 of the cutting knives meet at cutting edges 44, 46.

By "constant angle," we mean after the respective side has passed the normal radius "R" at the joinder of the respective side of the knife with the base land or the stripping land.

The distance between the first and second cutting knives, and thus the width of the trim element cut from the parent web, varies along the serpentine path of the cut, reaching a maximum width "W2" along a section 55 of the path where the path is oriented along the machine direction of the web, and reaching a minimum width "W3" along a section 57 of the path where the path is oriented transverse to the machine direction. As suggested by the combined teachings of FIGS. 1 and 2, in the embodiment illustrated therein, the minimum width dimension "W3" corresponds with the maximum thickness dimension "T2," whereby the tendency for the trim element to become lodged between the cutting knives corresponds with the minimum width of the trim element, where the trim element may be most susceptible to tearing when stressed in dislodging the trim element from between the cutting knives.

Figure 6:
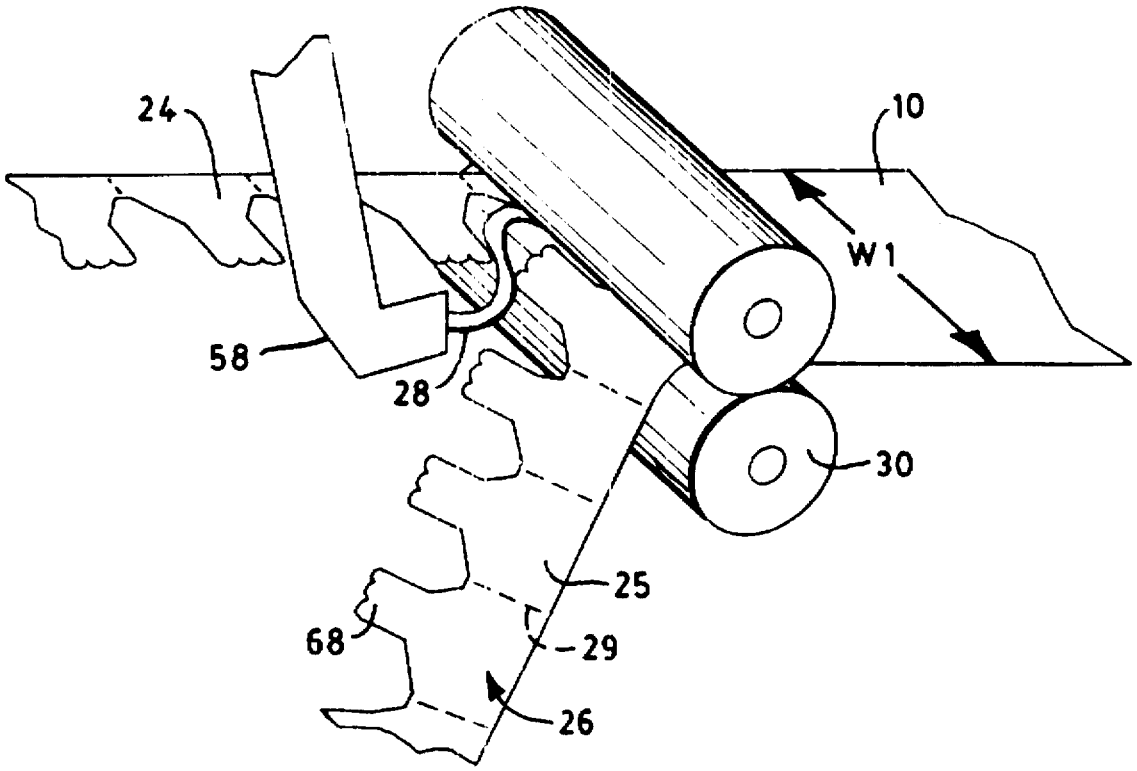
FIG. 6 shows a pictorial view of a process wherein a continuous web is being cut into two tab strip elements and a single narrow trim element between the strip elements, with the trim element being removed by a vacuum shoe.

The inventors have surprisingly found that the minimum width "W3" of the trim element can be less than 0.50 inch, down to 0.25 inch or less, without the trim element becoming so tightly lodged in the trim zone 47 of the cutting die 30 that it cannot be removed by modest vacuum in the vacuum shoe. Preferably, the trim element has a minimum width of no more than 0.38 inch. As illustrated in FIG. 6, the trim element is removed by the vacuum shoe 58 or the like, located adjacent the cutting die 30.

Figure 7:
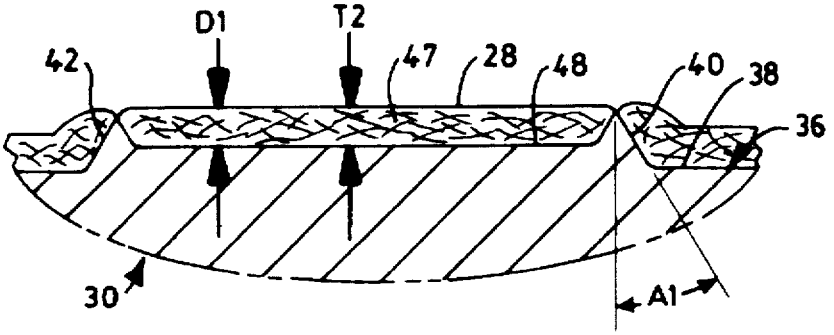
FIG. 7 shows an enlarged cross-section as in FIG. 5, and includes the cut elements of the web.

FIGS. 6 and 7 illustrate the operation of the invention. With respect to the specific embodiment illustrated therein, a trim element 28 wherein "T2" is 0.062 inch, is disposed between the cutting knives 40, 42, in the trim zone 47 between the knives. The depth "D1" of the trim zone is 0.053 inch. Thus the depth "D1" of the trim zone is only about 0.85 times as great as the thickness "T2" of the web 10. While the trim zone can be somewhat deeper than illustrated, generally the depth of the trim zone is controlled such that the depth "D1" is no more than 1.25 times the thickness "T2" of the web at the locus of minimum width of the trim element. Preferably, the depth "D1" is no greater than the thickness "T2" of the web. As illustrated in FIG. 7, where the web 10 is somewhat compressible, the depth "D1" is preferably somewhat less than the thickness of the web at the minimum width of the trim element, down to about 0.75 times the thickness of the web.

The depths given above are, of course, illustrative only, and the invention is not limited thereby. Rather, the invention is seen embodied in the relationships so illustrated, whereby the exact dimensions are less important in and of themselves. Accordingly, the heights, depths, and the like, of a given embodiment can be more, or less, than those illustrated, so long as the relationships illustrated among the several elements are retained.

The angles "A1" and "A2" of the sides of the cutting knives should be sufficiently great that the cutting knives are strong, and sufficiently small that the cutting knives terminate in edges sufficiently sharp for cutting the web 10. Angles of about 25 degrees to about 45 degrees have been found satisfactory. Angles of about 30 degrees are preferred. Where angles "A1" and "A2" are less than about 25 degrees, the knife is undesirably weak, and may break. Where the angles "A1" and "A2" are greater than about 45 degrees, cutting performance is reduced from optimum.

The cutting edges 44, 46 reside in an imaginary surface 41. The stripping land 48 resides in a surface intermediate the base land and the imaginary surface 41.

The height "H1" of the stripping land 48 should be at least 30%, preferably at least 40%, and may be as great as 50%, as great as the depth "D2," or more, in order that the stripping land assist in removing the element from the cutting die 30.

The parent web 10, and correspondingly the tab strip elements 24, 26, can be composed of a substantially non-elastomeric material, such as polymer films, woven fabrics, nonwoven fabrics or the like, as well as combinations thereof.

In particular aspects of the invention, the substrate layer 12 is composed of an elasticized material, such as a stretch-bonded-laminate (SBL) material, a neck-bonded-laminate (NBL) material, an elastomeric film, an elastomeric foam material, or the like. For example, suitable meltblown elastomeric fibrous webs are described in U.S. Pat. No. 4,663,220 issued May 5, 1987 to T. Wisneski et al., the disclosure of which is hereby incorporated by reference. Examples of composite fabrics comprising at least one layer of nonwoven textile fabric secured to a fibrous elastic layer are described in U.S. Pat. No. 4,720,415 issued Jan. 19, 1988, to Vander Wielen et al, the disclosure of which is hereby incorporated by reference. Examples of NBL materials are described in U.S. Pat. No. 5,226,992 issued Jul. 13, 1993, to Mormon, the disclosure of which is hereby incorporated by reference.

The separately provided reinforcing layer 14 is composed of a reinforcing material, and is laminated to the first surface 56 of the substrate layer 12. The shown reinforcing layer 14 extends along substantially the entirety of the lengths of the tab strip elements 24, 26, and correspondingly along substantially the entirety of the lengths of the respective tabs 25.

The reinforcing layer 14 can include a release tape as layer 16, and the release tape can include a substrate composed of a polymer film, such as a polypropylene film. Suitable release tape materials are available from Avery Corporation, having offices in Painesville, Ohio. Alternatively, layer 16 may be the hook or loop component of a hook and loop type fastener, as are well know to those skilled in the art.

Figure 9:
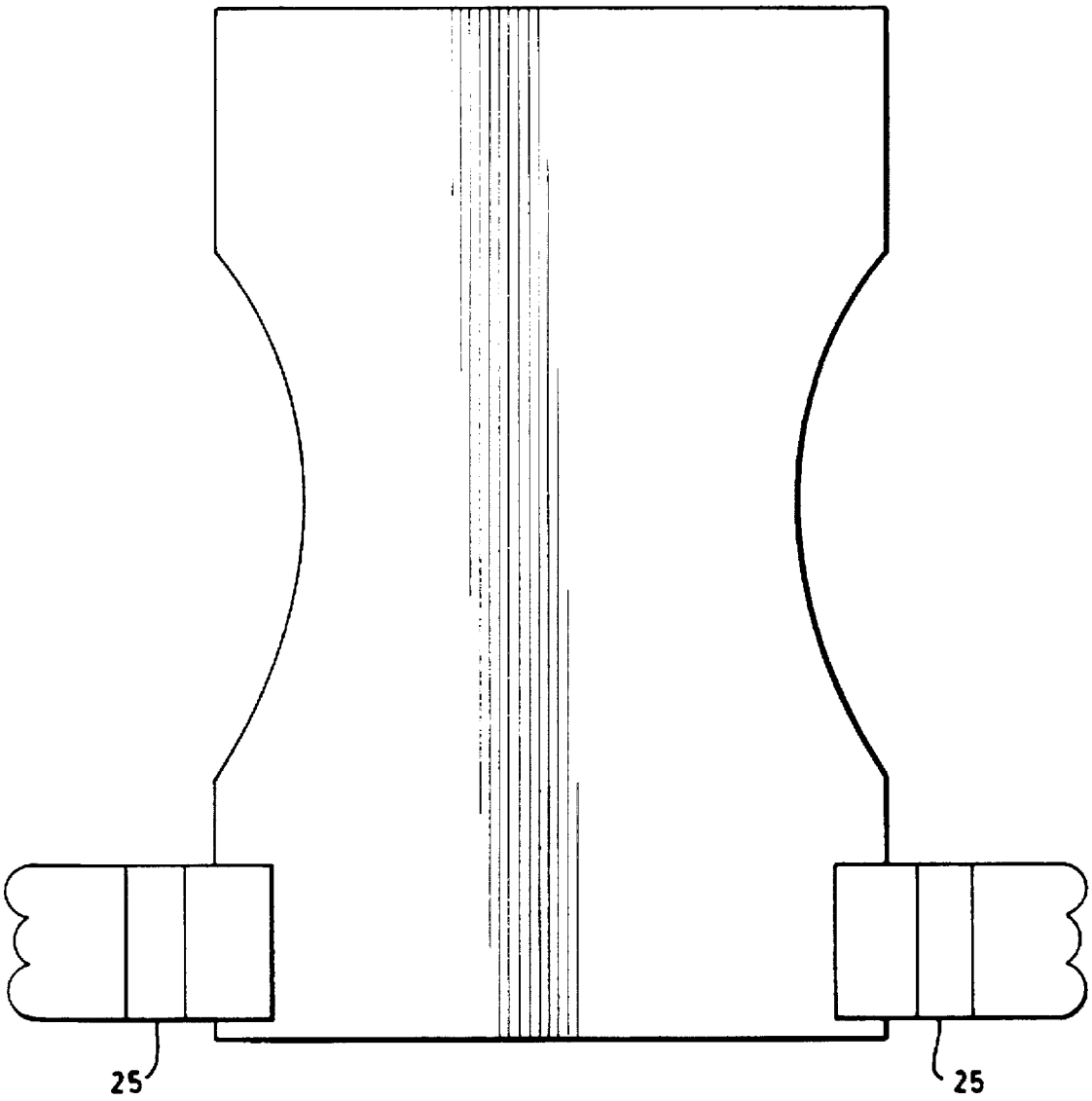
FIG. 9 shows an outline of a disposable diaper including thereon tabs made with the invention.

The release tape configuration of the reinforcing layer 14 can have a release surface 64 on layer 16 and an oppositely located attachment surface 66 between layers 14 and 16. A suitable release material, which has a limited low level adhesion to conventional pressure-sensitive adhesives, is positioned and distributed over the release surface 64 of layer 16, and a suitable attachment mechanism, such as a layer of construction adhesive, may be distributed between layers 14 and 16, to affix the layers 14 and 16 to each other. In particular, a strip of release tape can be operably bonded and laminated, as layer 16, to the outboard region 68 of the reinforcing layer 14 in each tab 25. Finally, a layer of construction adhesive may be used to affix the tab 25 onto an appointed section of the final article, such as the diaper illustrated in FIG. 9.

It is contemplated that the operation and functions of the invention have become fully apparent from the foregoing description of elements, but for completeness of disclosure the usage of the invention will be briefly described.

EXAMPLE

A parent web having a maximum thickness of 0.062 inch was selected for cutting using a cutting die of the invention as illustrated in FIG. 5. The depth "D1" to the stripping land 48 was 0.053 inch. The depth "D2" to the base land 38 was 0.093 inch. The web was fed through a cutter comprising a cutting die and an anvil roll as illustrated in FIG. 6. The minimum trim width "W3" of 0.25 inch corresponded with the maximum web thickness "T2" of 0.062 inch. Machine direction web speed through the cutting die was about 200 feet per minute. Force on the combined cutting edges was about 12000 pounds, exerted by the combination of the two nominal points of contact between the cutting knives and the anvil roll. The trim element was removed using a vacuum shoe as illustrated at 58 in FIG. 6, the shoe drawing 500 cubic feet of air per minute through a shoe opening of 12.5 square inches. The web 10 was cut cleanly. The trim element was removed by the vacuum shoe as a continuous strip without breakage and without lodging in the trim zone.

COMPARATIVE EXAMPLE

The same parent web as in the above example was fed through a cutter in all manner the same as the cutter used in the above Example, except that the depth to the stripping land was 0.93 inch. After a short run time, the trim element became lodged in the trim zone, with several layers becoming impacted in the trim zone, whereupon the cutting became sporadic, and breakage occurred at the cutting knives.

While the above description discusses the die structure in the context of a sleeve on a core support cylinder, other conventional die substrates are contemplated as supporting the elongated cutting knives, and are included within the claims which follow. For example, the die could be a solid cylinder, having the elongated cutting knives 40, 42 as integral elements of the cylinder.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

Having thus described the invention, what is claimed is:

1. A cutting die for cutting web elements from a parent web, said cutting die comprising:

(a) a die substrate having a base land for receiving the parent web to be cut;

(b) first and second elongated cutting knives mounted on said die substrate at said base land, said first and second elongated cutting knives extending to respective first and second cutting edges at respective first and second heights, the first and second heights being measured from said base land, said first and second cutting knives extending alongside but being separated from each other along a path, thus defining a trim zone between said first and second elongated cutting knives; and (c) an elevated stripping land in said trim zone, extending alongside and at least propinquant at least one of said first and second elongated cutting knives, said elevated stripping land having a third height, measured from said first base land, shorter than said first and second heights, said stripping land being non-compressible, said elevated stripping land comprising first and second elevated stripping land elements each extending alongside a respective one of said first and second elongated cutting knives, said stripping land elements being separated from each other.

2. A cutting die as in claim 1, said first and second elevated stripping land elements each extending generally continuously alongside the respective one of said first and second elongated cutting knives.

3. A cutting die as in claim 1, said first and second cutting knives having respective first and second lengths, said first and second elevated stripping land elements extending along the first and second lengths and between said first and second cutting knives at the third height, the third height being generally uniform along the path.

4. A cutting die as in claim 3, the third height of said first and second stripping land elements being at least 30 percent as great as the first and second heights.

5. A cutting die as in claim 4, said trim zone comprising a minimum width between said first and second elongated cutting knives, at the first and second heights, of no more than about 0.50 inch.

6. A cutting die as in claim 3, the third height of said first and second stripping land elements being about 40 percent to about 50 percent of the first and second heights.

7. A cutting die as in claim 3, said trim zone comprising a minimum width between said first and second elongated cutting knives, at the first and second heights, of no more than about 0.50 inch.

8. A cutting die as in claim 1, said first and second cutting edges being located at a first imaginary surface disposed outwardly of said die substrate by the magnitude of the first and second heights, said first and second elevated stripping land elements being located at a second imaginary surface intermediate said base land and said first imaginary surface.

9. A cutting die as in claim 1, each of said first and second elongated cutting knives having first and second elongated sides, said second elongated sides extending upwardly from said first and second elevated stripping land elements at a constant angle, the upward extensions thereof terminating at the respective ones of said first and second cutting edges.

10. A cutting die as in claim 1, each of said first and second elongated cutting knives having first and second elongated sides, said first elongated sides extending upwardly from said base land at a first constant angle, the upward extensions thereof terminating at the respective ones of said first and second cutting edges.

11. A cutting die as in claim 10, said second elongated sides extending upwardly from said first and second elevated stripping land elements at a second constant angle, the upward extensions thereof terminating at the respective ones of said first and second cutting edges.

12. A cutting die as in claim 11, said cutting die having a center of rotation, the respective said first and second constant angles being between about 25 degrees and about 45 degrees, measured from a line extending through the center of rotation of said cutting die to the respective said elongated sides.

13. A cutting die as in claim 1, said trim zone comprising a minimum width between said first and second elongated cutting knives, at the first and second heights, of no more than about 0.50 inch.

14. A cutting die as in claim 1, said trim zone comprising a minimum width between said first and second elongated cutting knives, at the first and second heights, of no more than about 0.25 inch.

15. A cutting die as in claim 14, each of said first and second elongated cutting knives having first and second elongated sides, the first elongated sides extending upwardly from said base land at a first constant angle, the respective said second elongated sides extending upwardly from said first and second elevated stripping land elements at a second constant angle, the upward extensions of said first and second elongated sides terminating at respective ones of said first and second cutting edges, said cutting die having a center of rotation, the respective said first and second constant angles being between about 25 degrees and about 45 degrees from a line extending through the respective said cutting edges and the center of rotation of said cutting die.

16. A cutting die as in claim 1, including a recessed portion of the trim zone between said first and second elevated stripping land elements.

17. A method of cutting web elements from a generally endless flexible parent web having a maximum thickness to be cut, the method comprising the steps of:

(a) feeding the parent web to a cutting die having a circumference, and having first and second elongated cutting knives mounted on a die substrate at a base land, the first and second elongated cutting knives extending to respective first and second cutting edges at respective first and second heights, the first and second heights being measured from the base land, the first and second cutting knives extending alongside but being separated from each other along a path about the circumference of the cutting die, thus defining a trim zone between the first and second elongated cutting knives, and an elevated stripping land in the trim zone, extending alongside and at least propinquant at least one of the first and second elongated cutting knives, the elevated stripping land having a third height, measured from the first base land, shorter than the first and second heights, the trim zone having a first depth to the stripping land, measured from the first and second cutting edges, less than a second depth to the base land; and (b) bringing the cutting die into cutting relationship with an anvil, with the parent web between the cutting die and the anvil, and thereby cutting web elements from the parent web, including a trim element in the trim zone.

18. A method as in claim 17, the elevated stripping land being contiguous with both of the first and second elongated cutting knives.

19. A method as in claim 17, wherein the first and second cutting knives have respective first and second lengths and the elevated stripping land extends along the first and second lengths and between the first and second cutting knives at the third height, the third height being generally uniform.

20. A method as in claim 17, wherein the first depth is no more than 70 percent as great as the second depth.

21. A method as in claim 17, wherein the trim zone comprises a minimum width between the first and second cutting edges, at the first and second heights, of no more than about 0.50 inch.

22. A method as in claim 17, wherein the first depth, from the first and second cutting edges to the stripping land, is no more than about 1.25 times the maximum thickness of the parent web at the trim element, and including the step of stripping the trim element out of the trim zone as a continuous strip of material.

23. A method as in claim 18, including limiting the first depth, of the trim zone, to no more than about 1.25 times the maximum thickness of the parent web at the trim element.

24. A method as in claim 17, including stripping the trim element from the stripping land as a continuous strip of indefinite length.

25. A method of separating a trim element from a parent web along a serpentine path, the parent web having a maximum thickness, the trim element having periodic, repeating, minimum and maximum widths, and minimum and maximum thicknesses, the method comprising the steps of:

(a) feeding the parent web to a cutting die having first and second elongated cutting knives mounted on a die substrate at a base land, the first and second elongated cutting knives extending to respective first and second cutting edges at respective first and second heights, the first and second heights being measured from the base land, the first and second cutting knives extending alongside, and being separated from, each other along the serpentine path, thus defining a trim zone on the cutting die between the first and second elongated cutting knives, and an elevated stripping land in the trim zone, extending alongside and at least propinquant at least one of the first and second elongated cutting knives, the elevated stripping land having a third height, measured from the base land, shorter than the first and second heights, the trim zone having a first depth to the stripping land, measured from the first and second cutting edges, less than a second depth to the base land, and no greater than the maximum thickness of the parent web;

(b) bringing the cutting die into cutting relationship with an anvil, with the parent web between the cutting die and the anvil, and thereby separating the trim element from the parent web, with the trim element being disposed at the stripping land between the first and second cutting knives, the repeating minimum width of the trim element being no more than 0.38 inch; and (c) stripping the trim element from the stripping land as a continuous strip of indefinite length.

26. A method of separating a trim element from a parent web having a maximum thickness, the method comprising the steps of:

(a) feeding the parent web to a cutting die having first and second elongated cutting knives mounted on a die substrate at a base land, the first and second elongated cutting knives extending to respective first and second cutting edges at respective first and second heights, the first and second heights being measured from the base land, the first and second cutting knives extending alongside but being separated from each other along a path, thus defining a trim zone on the cutting die between the first and second elongated cutting knives, and an elevated stripping land in the trim zone, extending alongside and at least propinquant at least one of the first and second elongated cutting knives, the elevated stripping land having a third height, measured from the base land, shorter than the first and second heights, the trim zone having a first depth to the stripping land, measured from the first and second cutting edges, less than a second depth to the base land;

(b) bringing the cutting die into cutting relationship with an anvil, with the parent web between the cutting die and the anvil, and thereby separating the trim element from the parent web, with the trim element being disposed at the stripping land between the first and second cutting knives; and (c) stripping the trim element from the cutting die as a continuous strip of indefinite length.

27. A method as in claim 26, said first and second cutting knives extending alongside but being separated from each other along a path about a circumference of said cutting die.

28. A method as in claim 26, the stripping land being non-compressible.

29. A method as in claim 26, the stripping land being metal.

30. A method of cutting web elements from a generally endless flexible parent web having a maximum thickness to be cut, the method comprising the steps of:

(a) feeding the parent web to a cutting die having first and second elongated cutting knives mounted on a die substrate at a base land, the first and second elongated cutting knives extending to respective first and second cutting edges at respective first and second heights, the first and second heights being measured from the base land, the first and second cutting knives extending alongside each other along a path, thus defining a trim zone between the first and second elongated cutting knives, and an elevated stripping land in the trim zone, extending alongside and at least propinquant at least one of the first and second elongated cutting knives, the elevated stripping land having an outer stripping surface at a third height, measured from the first base land, shorter than the first and second heights, the stripping land being non-compressible, the trim zone having a first depth to the stripping land, measured from the first and second cutting edges, less than a second depth to the base land; and (b) bringing the cutting die into cutting relationship with an anvil, with the parent web between the cutting die and the anvil, and thereby cutting web elements from the parent web, including a trim element in the trim zone, the trim element being compressed against the non-compressible stripping land, the stripping land thus assisting in preventing lodging of the trim element between the first and second elongated cutting knives.

31. A method as in claim 30 wherein the first depth is no more than 70 percent as great as the second depth.

32. A method as in claim 30 wherein the trim zone comprises a minimum width between the first and second cutting edges, at the first and second heights, of no more than about 0.50 inch.

33. A method as in claim 30 wherein the trim zone comprises a minimum width between the first and second cutting edges, at the first and second heights, of no more than about 0.38 inch.

34. A method as in claim 30 wherein the first depth, from the first and second cutting edges to the stripping land, is no more than about 1.25 times the maximum thickness of the parent web at the trim element, and including the step of stripping the trim element out of the trim zone as a continuous strip of material.

35. A method as in claim 30, including stripping the trim element from the stripping land as a continuous strip of indefinite length.

* * * * *